US008948437B2

(12) United States Patent
Paye

(10) Patent No.: US 8,948,437 B2
(45) Date of Patent: Feb. 3, 2015

(54) AUDIO SPEAKER ASSEMBLY INCLUDING 360° SPEAKER ROD SUCH AS FOR INCORPORATING INTO A WATERCRAFT AND INCLUDING PORTABLE SUPPORT MODULE WITH REMOTE CLOUD STORAGE AND RETRIEVAL CAPABILITIES

(76) Inventor: Justin A. Paye, Harrison Township, MI (US)

( * ) Notice: Subject to any disclaimer, the term of this patent is extended or adjusted under 35 U.S.C. 154(b) by 46 days.

(21) Appl. No.: 13/606,206

(22) Filed: Sep. 7, 2012

(65) Prior Publication Data

US 2013/0058520 A1 Mar. 7, 2013

Related U.S. Application Data

(60) Provisional application No. 61/531,757, filed on Sep. 7, 2011.

(51) Int. Cl.
*H04R 1/02* (2006.01)
*H04R 5/02* (2006.01)

(52) U.S. Cl.
CPC .. *H04R 1/02* (2013.01); *H04R 5/02* (2013.01); *H04R 2499/13* (2013.01)
USPC ..... 381/386; 381/387; 381/388

(58) Field of Classification Search
USPC ..... 381/386, 387, 388
See application file for complete search history.

(56) References Cited

U.S. PATENT DOCUMENTS

| | | | | |
|---|---|---|---|---|
| 4,270,023 | A | 5/1981 | Beveridge | |
| 4,616,731 | A | 10/1986 | Robinson | |
| 5,734,728 | A | 3/1998 | Meissner | |
| 6,122,390 | A | 9/2000 | Rosswork | |
| 6,243,260 | B1 * | 6/2001 | Lundgren et al. | 361/679.23 |
| 6,859,543 | B2 | 2/2005 | Fingleton | |
| 7,654,362 | B2 | 2/2010 | Suzuki et al. | |
| 7,814,583 | B2 * | 10/2010 | Lerma | 4/541.1 |
| 8,175,318 | B2 * | 5/2012 | Pieklik et al. | 381/387 |
| 8,243,963 | B2 | 8/2012 | Gladwin et al. | |
| D670,676 | S | 11/2012 | Diedrich et al. | |
| 8,577,068 | B2 * | 11/2013 | Oh | 381/334 |
| 2007/0011934 | A1 | 1/2007 | Rayfield | |
| 2008/0141924 | A1 | 6/2008 | Adams | |

* cited by examiner

*Primary Examiner* — Davetta W Goins
*Assistant Examiner* — Amir Etesam
(74) *Attorney, Agent, or Firm* — Gifford, Krass, Sprinkle, Anderson & Citkowski, P.C.; Douglas J. McEvoy

(57) ABSTRACT

An audio speaker assembly for providing a 360° all around audio output. A speaker rod includes an upper audio output portion and a lower extending insertion tube portion. A holder includes a longitudinally extending inner passageway for receiving the rod in inserting fashion, with an electrical output signal representative of a succeeding audio output being communicated to the holder and rod.

3 Claims, 8 Drawing Sheets

FIG. 9B
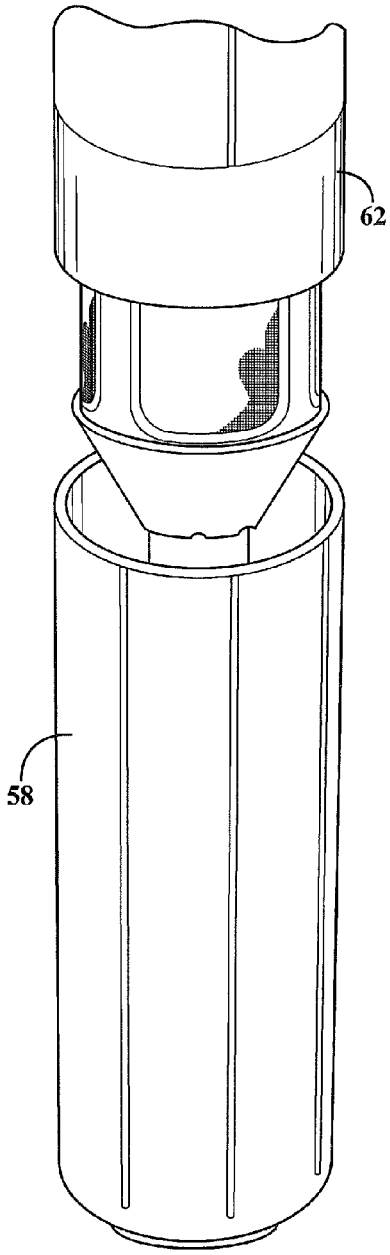
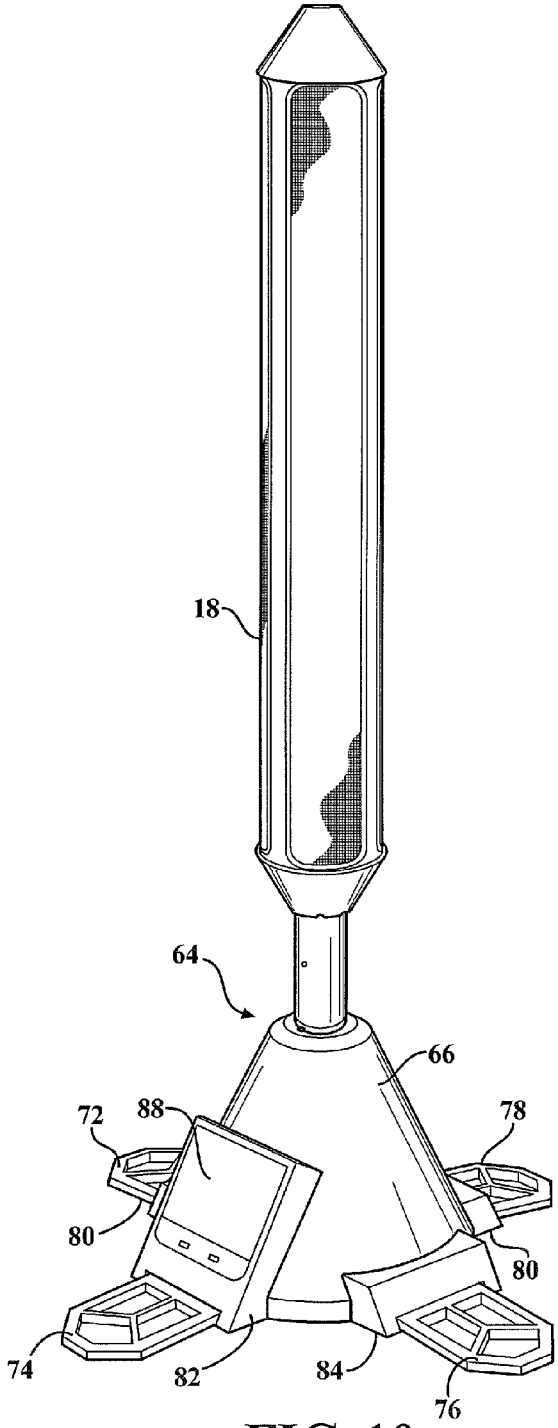
FIG. 10

AUDIO SPEAKER ASSEMBLY INCLUDING 360° SPEAKER ROD SUCH AS FOR INCORPORATING INTO A WATERCRAFT AND INCLUDING PORTABLE SUPPORT MODULE WITH REMOTE CLOUD STORAGE AND RETRIEVAL CAPABILITIES

CROSS REFERENCE TO RELATED APPLICATIONS

The present application claims the priority of U.S. Ser. No. 61/531,757 filed Sep. 7, 2011.

BACKGROUND OF THE INVENTION

1. Field of the Invention

The present invention is an audio rod in the form of an elongated and tubular shaped surround speaker seating within a modified rod holder. The rod holder exhibits a guide channel and associated wire connections for seating in electrically communicating fashion an inserting guide portion with locating guide screws engageable within a mating track or vertical slot defined in the rod holder and from which the audio rod upwardly projects. An outer HDPE or other suitable plastic case provides for environmentally secure storage of the audio rod when not in use. An additional portable and pedestal base unit substitutes for the rod holder, such as for portable (non-marine) applications and integrates a suitable power supply along with digital display screen (such as capacitive touch) to facilitate access and playback of music. Existing cloud storage and retrieval protocols can also be utilized, either along with or in substitution of digital storage built into the unit for accessing a music library.

2. Description of the Background Art

The prior art is documented with examples of marine relate audio devices. Among these, Rayfield US 2007/0011934 teaches a multi-use fishing holder with 360 degree audio and visual output alarm capability and in which the components are incorporated into the fixed tubular support. Additional marine speaker constructions of conventional variety are depicted in Rosswork, U.S. Pat. No. 6,122,390 and Adams US 2008/0141924.

A further class of generally tubular shaped speaker designs includes the speaker system of Fingleton, U.S. Pat. No. 6,859,543 with a top end opening. Other general cylindrical speaker designs, such as without limitation utilizing variations of audio permissive tubes combined with standard coaxial speaker output components, are referenced in each of Beveridge, U.S. Pat. No. 4,270,023, Robinson, U.S. Pat. No. 4,616,731, Meissner, U.S. Pat. No. 5,734,728 and Suzuki, U.S. Pat. No. 7,654,362.

Options for current boat sound systems typically include either the provision of stock speakers from the manufacturer, which tend to be of low quality, or custom systems which are often very expensive and are designed to be mostly audible from within the boat itself. Given that a significant amount of boating activities, including such as raft off parties, involves the participants being in the water surrounding the boat, an effective solution for providing a 360° surround sound profile is desired.

SUMMARY OF THE PRESENT INVENTION

The present invention discloses an audio speaker assembly for providing a 360° all around audio output. A speaker rod includes an upper audio output portion and a lower extending insertion tube portion. A holder includes a longitudinally extending inner passageway for receiving the rod in inserting fashion, with an electrical output signal representative of a succeeding audio output being communicated to the holder and rod.

Additional features include guide screws extending in longitudinally spaced and aligned fashion along the insertion tube for electrically communicating with the holder. An elongated tubular storage case with separable upper and lower portions is provided for storing the speaker rod when not in use.

Other features include a rod holder is mounted within a watercraft and includes a top mounting face plate and rotating upper cap. The holder may also include a portable base unit with built in processor and digital screen display for accessing at least one of an integrated digital to audio conversion library, an attachable portable memory storage device, or a wireless and cloud memory storage medium.

BRIEF DESCRIPTION OF THE DRAWINGS

Reference will now be made to the attached drawings, when read in combination with the following detailed description, wherein like reference numerals refer to like parts throughout the several views, and in which:

FIGS. 9A and 9B depict a series of assembly views of the storage case and audio rod;

FIG. 10 is an assembly view of the audio rod in use with the portable base unit according to an alternate application of the invention;

DETAILED DESCRIPTION OF THE PREFERRED EMBODIMENTS

Figure 1:
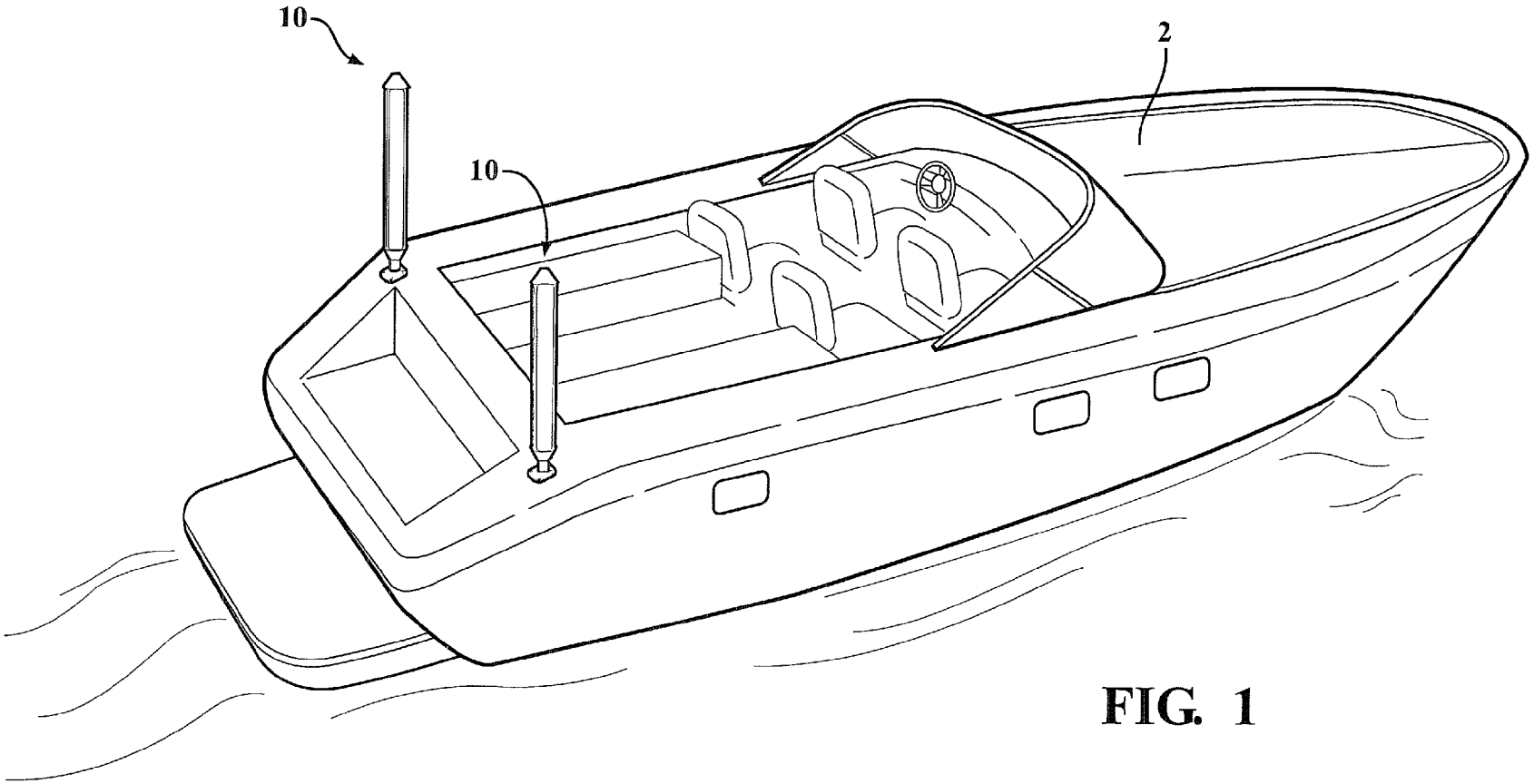
FIG. 1 is an environmental view of a pair of audio speaker assemblies supported upon associated rod holders incorporated into a watercraft according to one embodiment of the invention.
Figure 2:
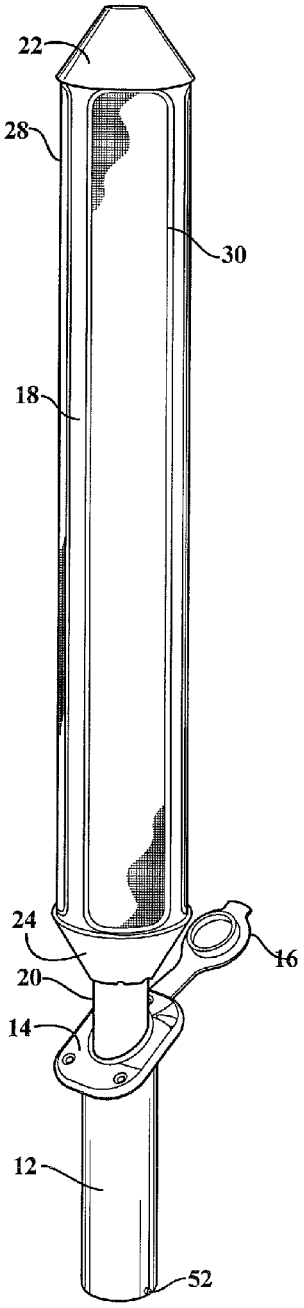
FIG. 2 is an assembled view of the audio rod and holder of FIG. 1.

With reference now to the following illustrations, the present inventions depict an audio rod for broadcasting about 360° a peripheral range an audio output, and which is depicted in the form of an elongated and tubular shaped surround speaker seating within a modified rod holder. FIG. 1 is an environmental view of a pair of audio speaker assemblies, both generally illustrated at 10, supported upon associated rod holders (see as further depicted at 12 in each of succeeding FIGS. 2, 3, 6 and 7 and which includes an angled top face plate 14 and flip up cap 16 (which in its engaged position protects the inner located electrical components from water), the cap 16 in its upward flipped position revealing an interior receiving passageway for inserting an audio rod 18 with lower insertion tube 20.

As further shown, the audio rods 10 are incorporated into a watercraft 2 (again FIG. 1) according to one embodiment of the invention. It is further understood that the 360° audio rod can be utilized in a number of potential applications, not limited to a watercraft, and such as envisioning either being seated within a suitable rod holder construction associated with any land, sea or air type vehicle or assembly, and in addition to the portable variant of FIG. 10.

The speaker 18 exhibits a substantially elongated and sleeve shaped portion with a 360° all around audio output (this illustrated variant including a plurality of perforated low density plastic grill (foam) output locations arranged in elongate extending and circumferentially spaced fashion and integrated within a stainless steel body. The design allows for music to be heard from all angles. It is further understood that any suitable perforated or porous hard, soft, foam or other covering material can be employed and which exhibits suitable audio transmission capabilities.

Figure 3:
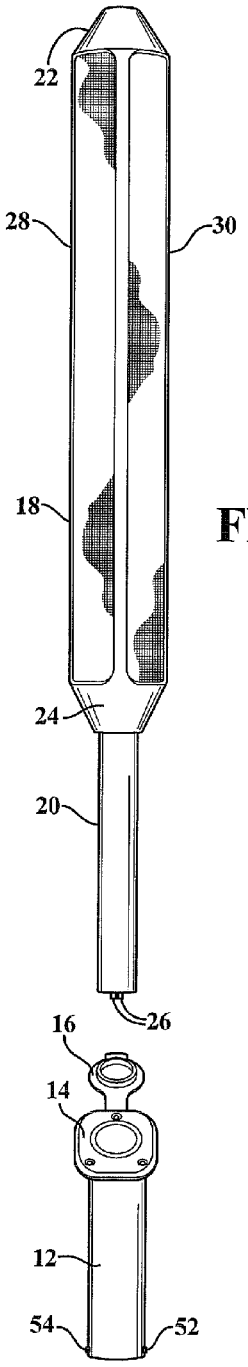
FIG. 3 is an exploded view of FIG. 2 illustrating the rod separated from the holder.
Figure 4:
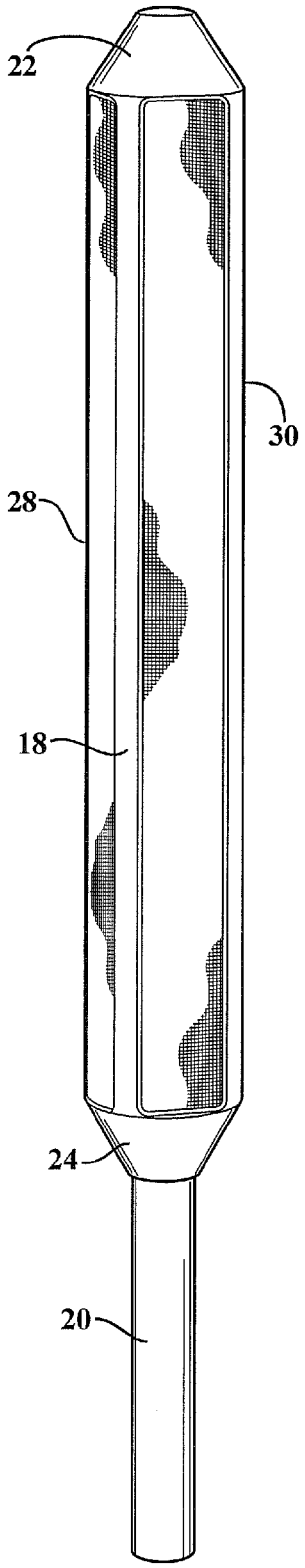
FIG. 4 illustrates the audio rod.

A conical tapered configuration 22 is located at one end of the elongated speaker output sleeve shaped portion, with a corresponding tapered configuration established at an opposite lower end 24. The insertion tube 20 extends integrally from the tapered lower end 24 and terminates, at bottom located speaker connections 26, as shown in FIG. 3. Without further elaboration, the speaker rod operates to receive an input signal through bottom end connections 26, and which is outputted through the output grill locations (see further at 28, 30, et seq. separated by stainless body supporting locations such as again at 18).

Figure 5:
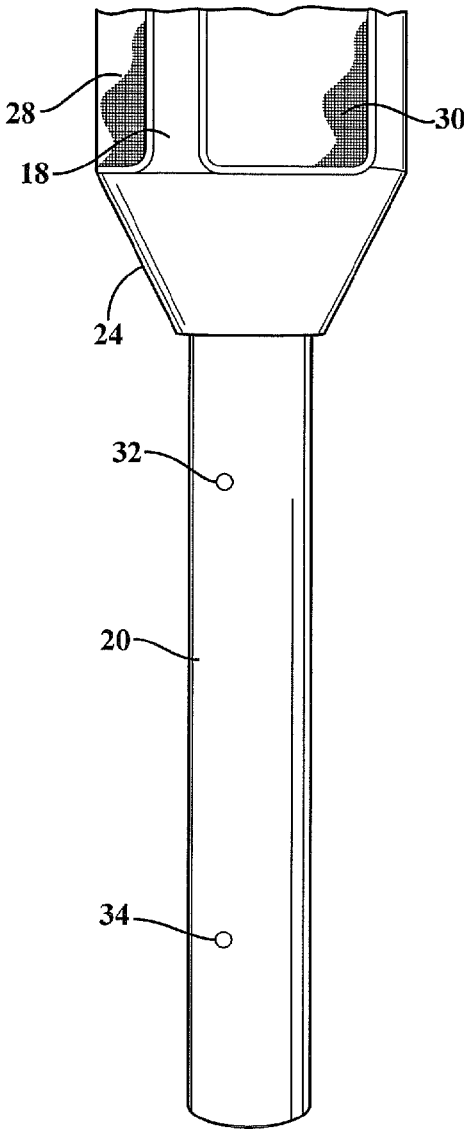
FIG. 5 is a further enlarged view of the lower inserting portion of the rod in FIG. 4 and illustrating the arrangement of the seating guide screws for correct alignment and insertion into the guide channel associated with the outer tubular passageway receiving rod holder.

A pair of guide screws 32 and 34 (see FIG. 5) project in longitudinally spaced and circumferentially aligned locations along the lower extending insertion tube 20. The guide screws 32 and 34 align with a linear guide channel 36 (FIG. 6) defined in a guide channel (see inner perimeter cylindrical wall 38) associated with the outer tubular passageway receiving rod holder 12 for receiving the aligning projecting screws 32 and 34 associated with the guide rod lower inserting portion in properly aligned and electrically communicating fashion. The rod holder 12, as best shown in FIG. 6, exhibits an angled upper face plate 40 (such as which may contour with the transom surface of the watercraft 2) with mounting fastener apertures 42, 44 and 46 arranged at perimeter spaced locations for receiving mounting screws or the like, see at 43, 45 and 47, in order to secure the rod holder to the watercraft hull (see also FIG. 1).

Figure 6:
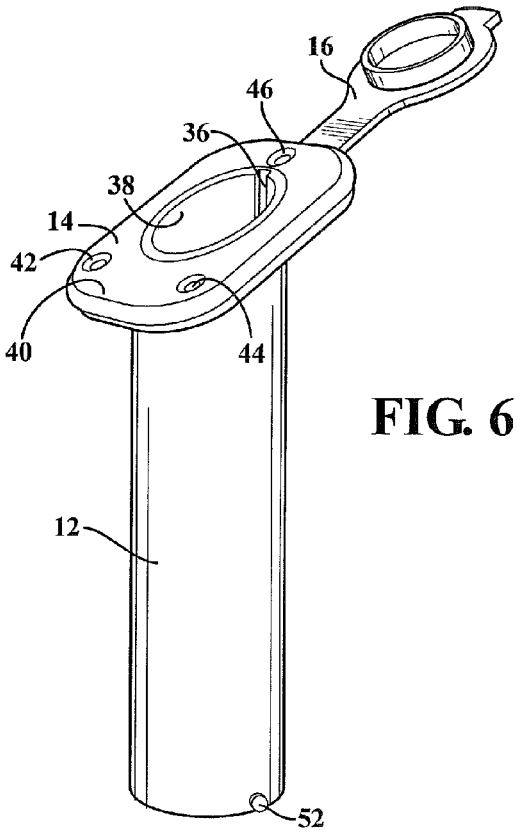
FIG. 6 illustrates the rod holder with flip-up rubber cap for enclosing the rod receiving passageway, the passageway further exhibiting the guide channel for receiving the aligning projecting screws associated with the guide rod lower inserting portion in properly aligned and electrically communicating fashion.
Figure 7:
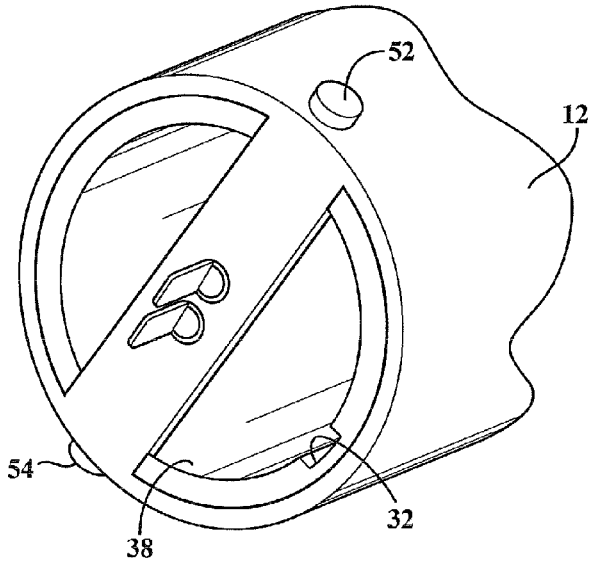
FIG. 7 is a rotated underside view of the rod holder in FIG. 6 and illustrating both centrally located audio rod disconnect and outer/opposite facing and removable speaker disconnect portions.

FIG. 6 further illustrates the rod holder 12 with flip-up rubber cap 16 for enclosing the rod receiving passageway. FIG. 7 depicts a rotated underside view of the rod holder in FIG. 6 and illustrating both centrally located audio rod disconnect portions 48 and 50 (these aligning with bottom extending connect portions 26 associated with the speaker rod tube 20. Additional and outer/opposite facing and removable speaker disconnect portions are further shown at 52 and 54 and which secures ends of connecting wires associated with the electrical system of the watercraft.

The audio rod holder 12 replaces a standard fishing rod holder commonly found on most boats and is constructed of a suitable material, such as but not limited to a 316 stainless steel which is rust resistant and able to withstand all weather conditions. The inner defining guide channel 36 and perimeter wall 38 can further be constructed of an electrically insulating nylon plastic and, by virtue of its construction, maintains an electrical connection with the audio rod. The base plate 14 is further configured according to a standardized angle consistent with a boat transom design, such as which can include any angular orientation ranging from 0° to 30° relative to a horizontal.

Figure 8:
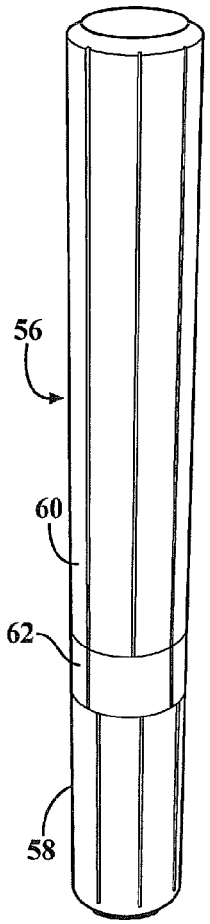
FIG. 8 is an illustration of an HDPE storage case for holding the audio rod when not in use.
Figure 9A:
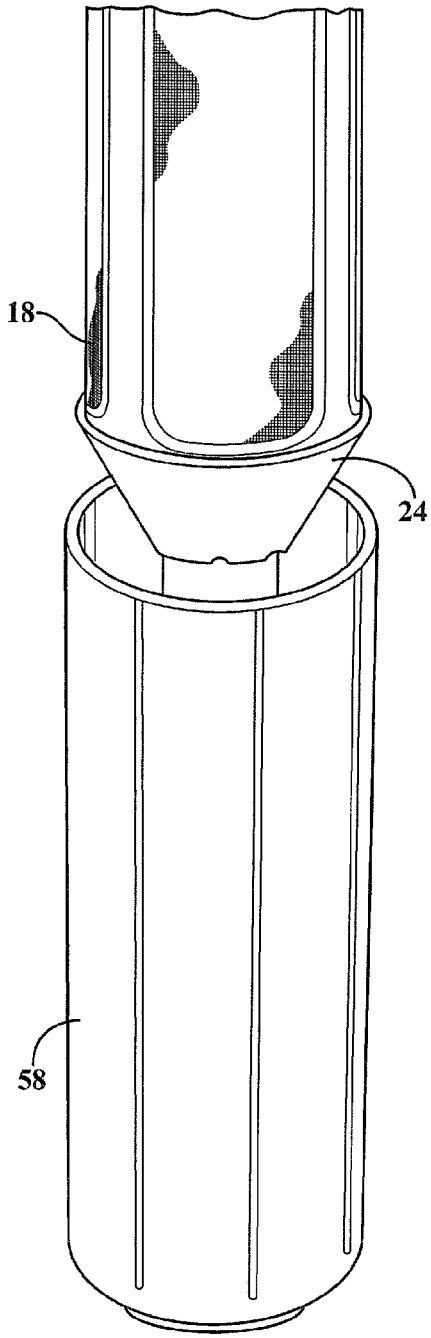

FIG. 8 is an illustration of an HDPE storage case, generally at 56 and including a lower tubular portion 58 and an upper assembleable tubular portion 60 which are installed together for capturing and safeguarding the audio rod 18 when not in use. FIGS. 9A and 9B depict a series of assembly views of the storage case and audio rod, the case being constructed of an HDPE or other suitable plastic, typically with a chrome or other suitable accent 62 defining an end of the upper separable portion 60 (see FIG. 9B). The case 56 establishes a water tight enclosure which keeps the speaker rod 18 clean, dry and safe from damage.

Figure 12:
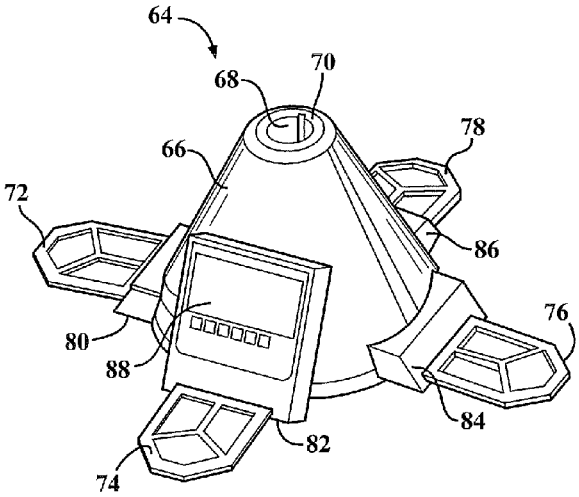
FIG. 12 is a sectional illustration of the portable base unit of FIG. 10 and further depicting the features of the fold out legs and digital display screen for facilitating access of either an integrated or remote/cloud supported audio digital library.
Figure 11:
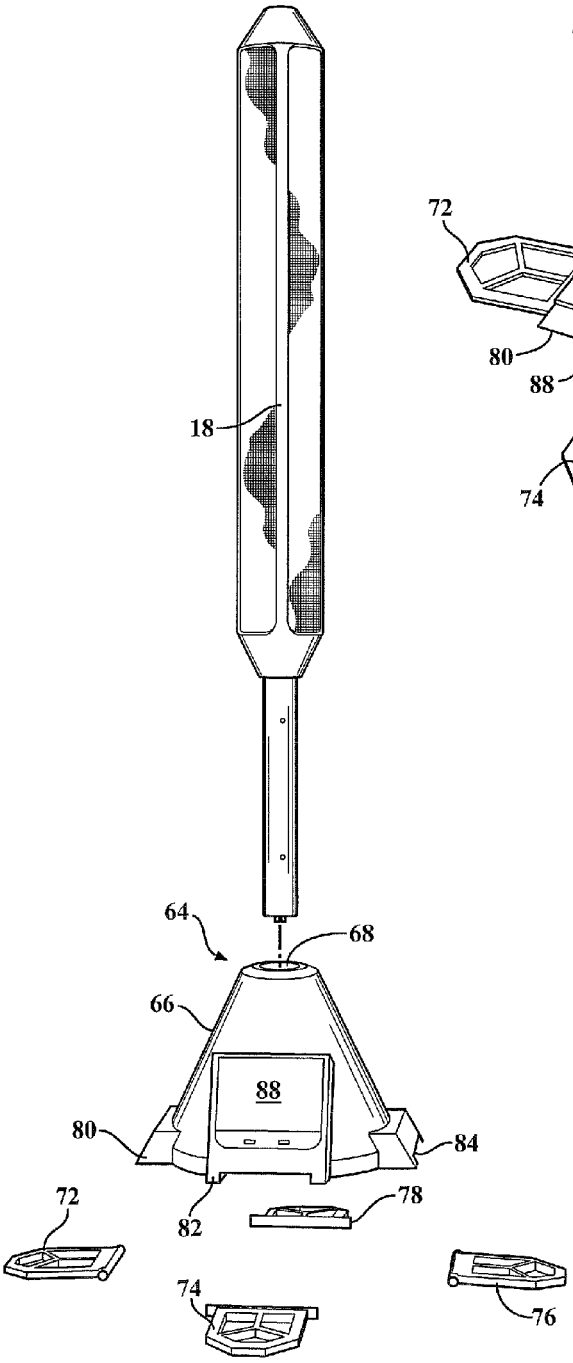
FIG. 11 is an exploded view of the assembly in FIG. 10.

FIG. 10 is an assembly view of the audio rod 18 in use with the portable base unit, generally at 64, according to an alternate application of the invention. As further depicted in the exploded view of FIG. 11 and succeeding assembled sectional view of FIG. 12, the base unit includes a generally conical or other suitable shaped body 66 with an upper receiving interior perimeter wall 68 (see exploded FIG. 11 and FIG. 12) with configured guide channel 70 for receiving the lower inserting portion 20 of the audio rod 18 in similar fashion to rod holder 12.

The portable rod holder further depicts the features of fold out legs 72, 74, 76 and 78 (such as which mount to pedestal located portions 80, 82, 84 and 86 associated with an underside of the main body 66). A digital display screen 88 is provided and facilitates access to an inner electrical architecture (not shown) associated with the operational aspects of the portable unit.

A portable battery source can also be integrated into the base unit and as an alternative to the wiring arrangement of FIG. 1. The portable unit can further integrate a internal digital memory storage or digital to audio conversion library (this also including a suitable auxiliary jack input for communicating a portable digital audio player such as an Ipod or portable drive or a mini or standard size USB port for likewise connecting a smart phone or thumb drive).

Figure 13:
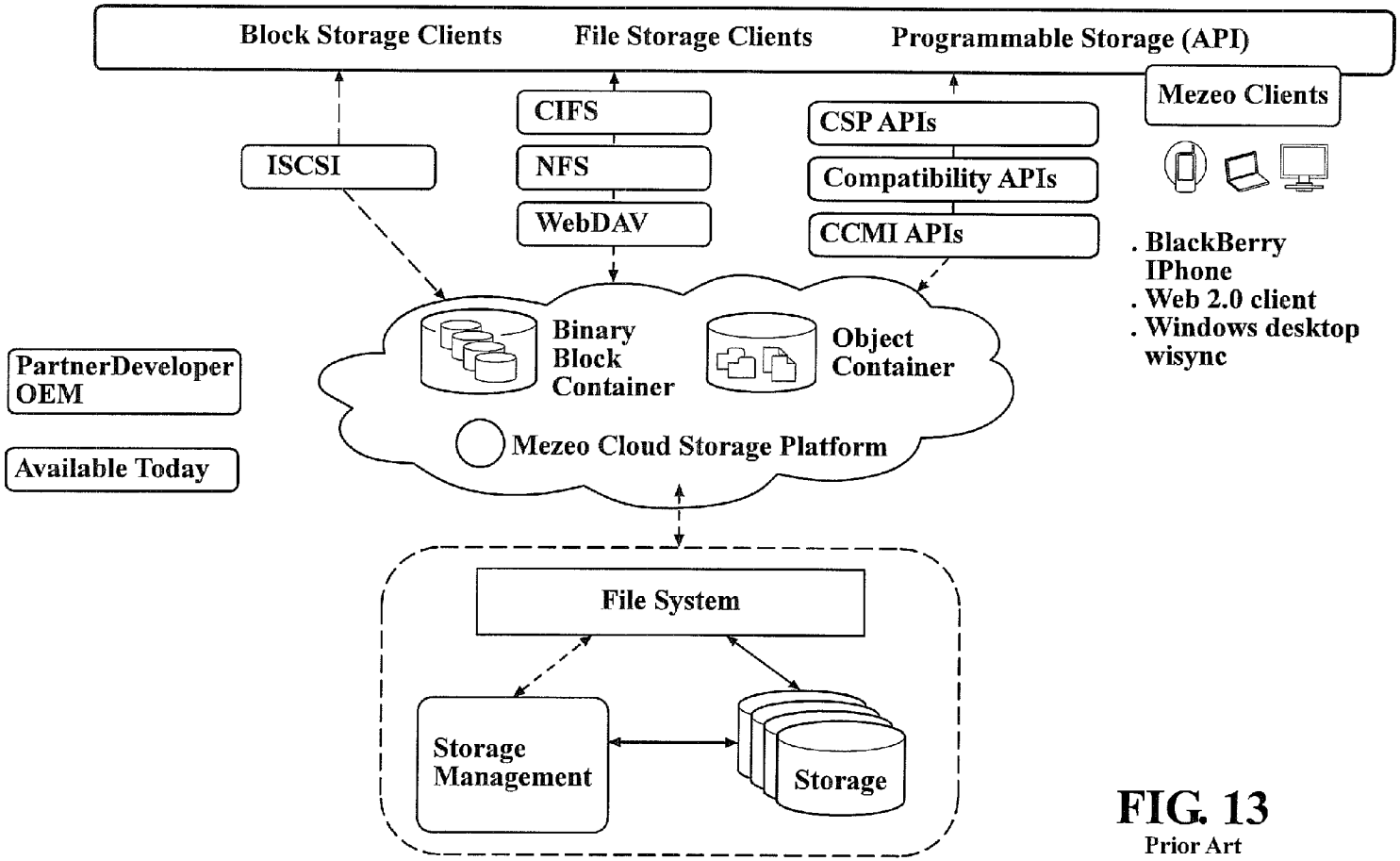
FIG. 13 Prior Art
FIG. 13 is a schematic flow diagram of a known cloud storage system for accomplishing retrieval and playback of a such as an audio digital file by the configured audio rod and portable base unit.

Additional or alternative to an integrated or separately communicable digital storage library, the speaker assembly according to any disclosed variant is also envisioned to communicate with a remote/cloud supported audio digital library. An example of this is further represented in the schematic flow diagram of FIG. 13 for accomplishing retrieval and playback of a such as an audio digital file by the configured audio rod and portable base unit (and which can be accessed by the digital input display 88 associated with the portable unit 64). The cloud storage capability allows a user to save their information to the database and to subsequently access the information wirelessly via the receiver, such as typically located inside the audio rod base.

Having described my invention, other and additional preferred embodiments will become apparent to those skilled in the art to which it pertains, and without deviating from the scope of the appended claims. This includes the speakers being reconfigured as wirelessly connected to a digital output receiver, and with a portable battery or other power supply being communicated to the speakers (and without limitation such as being housed within the cylinder part of the speaker that insets into the rod holder or otherwise built into the rod).

I claim:

1. An audio speaker assembly, comprising:

a speaker rod including an upper audio output portion incorporated into an elongated and sleeve shaped body, a plurality of individual and elongated audio output panels being configured along an exterior of said body in circumferentially spaced fashion;

a lower tubular shaped portion integrally extending from said elongated and sleeve shaped body; and an elongated and tubular shaped holder including a longitudinally extending inner passageway for receiving said tubular shaped portion in inserting fashion in a first mounting application and so that said upper audio output portion is anchored to said holder, an electrical output signal representative of a succeeding audio output being communicated to said holder and upper audio output portion;

a portable base unit with built in processor and digital screen display for accessing at least one of an integrated digital to audio conversion library, an attachable portable memory storage device, or a wireless and cloud memory storage medium, a body of said base including an upper receiving and interior perimeter defining wall which is configured to receive said tubular shaped portion upon disconnecting from said tubular shaped holder and attaching to said portable base unit in a second mounting application; and said speaker rod providing an audio output broadcasted over a 360° peripheral range.

2. The kit assembly as described in claim 1, said base unit further comprising a plurality of fold out legs which mount to pedestal located portions associated with an underside of said body.

3. The kit assembly as described in claim 1, further comprising guide screws extending in longitudinally spaced and circumferentially aligned fashion along said tubular shaped portion for electrically communicating said speaker rod with linear extending guide channels defined in each of said holder and portable base unit.

* * * * *